US007717428B2

(12) United States Patent
Turner, Sr.

(10) Patent No.: US 7,717,428 B2
(45) Date of Patent: May 18, 2010

(54) CHECKERS FOR THREE PLAYERS

(76) Inventor: James C. Turner, Sr., 1274 Highway 355, Etta, MS (US) 38627

( * ) Notice: Subject to any disclaimer, the term of this patent is extended or adjusted under 35 U.S.C. 154(b) by 0 days.

(21) Appl. No.: 12/079,926

(22) Filed: Mar. 31, 2008

(65) Prior Publication Data

US 2009/0243215 A1 Oct. 1, 2009

(51) Int. Cl.
*A63F 3/00* (2006.01)

(52) U.S. Cl. ..... 273/261; 273/262

(58) Field of Classification Search ..... 273/260, 273/261, 255, 262; D21/334, 348, 349, 363, D21/364, 369
See application file for complete search history.

(56) References Cited

U.S. PATENT DOCUMENTS

| | | | | | |
|---|---|---|---|---|---|
| 695,431 | A | | 3/1902 | Atwood | |
| 803,299 | A | * | 10/1905 | Morhous | 273/258 |
| 1,204,246 | A | | 11/1916 | Carter | |
| 1,555,937 | A | | 10/1925 | Billman | |
| D140,555 | S | | 3/1945 | Ruffin | |
| 2,379,465 | A | | 7/1945 | Vollmer | |
| D173,152 | S | | 10/1954 | Gee | |
| 3,744,797 | A | | 7/1973 | Hopkins | |
| D231,848 | S | * | 6/1974 | Mobert | D21/348 |
| 3,840,237 | A | * | 10/1974 | Shkolnik | 273/261 |
| 3,963,242 | A | | 6/1976 | Treugut et al. | |
| 4,136,880 | A | | 1/1979 | Rikon | |
| 4,348,027 | A | | 9/1982 | Escamilla-Kelly | |
| D270,921 | S | * | 10/1983 | Morgan | D21/335 |
| D272,373 | S | * | 1/1984 | Kowal | D21/348 |
| 4,556,221 | A | * | 12/1985 | Borland | 273/248 |
| 4,653,759 | A | * | 3/1987 | Anderson et al. | 273/261 |
| D299,836 | S | * | 2/1989 | Kropfl | D21/348 |
| 5,803,457 | A | | 9/1998 | Smith | |
| 6,357,748 | B1 | | 3/2002 | Tomkovich | |
| 6,478,300 | B1 | | 11/2002 | Pickett | |
| 2009/0096163 | A1 | | 4/2009 | Rutherford | |

OTHER PUBLICATIONS

Chamberlain, Ken, Tri-Chek: Checkers Played by Three, www.trichek.com (Nov. 20, 2003) (8 pages), Aurora, Illinois, U.S.A.

* cited by examiner

*Primary Examiner*—Vishu K Mendiratta
(74) *Attorney, Agent, or Firm*—Walker, McKenzie & Walker, P.C.

(57) ABSTRACT

A game board and rules that allow three players to play a game based on traditional checkers but requiring additional moves through a triangular central field of play. In one version, the central field is composed of three concentric equilateral triangles made up of discs. In another version there are two concentric equilateral triangles of discs arranged around a triangular central void. The rules of play differ between the two versions because of the difference in configuration of the game board.

2 Claims, 11 Drawing Sheets

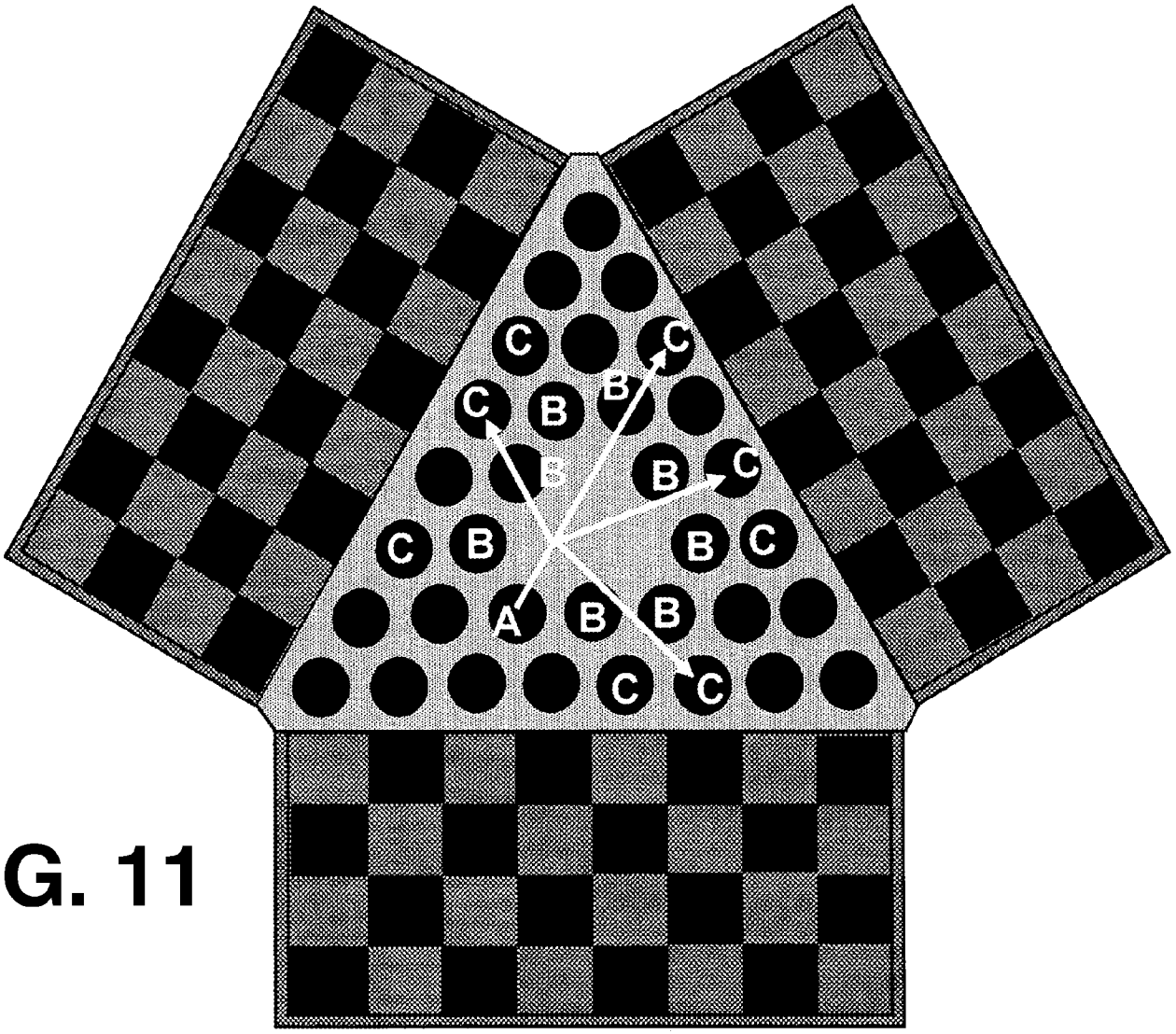
C
B
C
B
C
B

CHECKERS FOR THREE PLAYERS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

The classic game of "checkers" has been varied in many ways over the years. It is usually a two-person game in which one-half of the classic checkerboard comprising 32 squares—16 of one color (usually black) and 16 of another color (usually red) —is the domain of one player and the other one-half is the domain of a second player.

There are variations of checkers for more than two players, but few are for three players.

There are variations of checkers and other board games that have been implemented on personal computers, on a host network or in an integral small device for a single player, typically, to play against the device. It is contemplated that the version of checkers disclosed herein may also be so implemented using appropriate software or a suitable microchip to allow the device to take the part of two of the three players.

The present variation of the classic checkers board game makes changes in the game and how it is played, but includes the possibility of using conventional checker pieces (albeit in three colors instead of two) or using other types of pieces as "checkers."

BRIEF SUMMARY OF THE INVENTION

This invention consists of a game board and rules that allow three players simultaneously to play a game based on the traditional game of checkers. The game board provides a Home Base for each of three players (instead of two, as in traditional checkers) separated by a triangular Battle Zone in which the game pieces are allowed more freedom of movement than in their Home Bases. The object of the game is, as in traditional checkers, to avoid capture so that you have pieces remaining on the gameboard after all pieces of both opponents have been captured. The invention includes a second variation or embodiment that uses a gameboard in which the Battle Zone is configured in a different manner.

BRIEF DESCRIPTION OF THE SEVERAL VIEWS OF THE DRAWINGS

FIG. 11 is a schematic view of the moves that may be made by a game piece to jump and capture an opponent's game piece to exit the Battle Zone and enter an opponent's Base according to the second embodiment of the present invention.

DETAILED DESCRIPTION OF THE INVENTION

Figure 1:
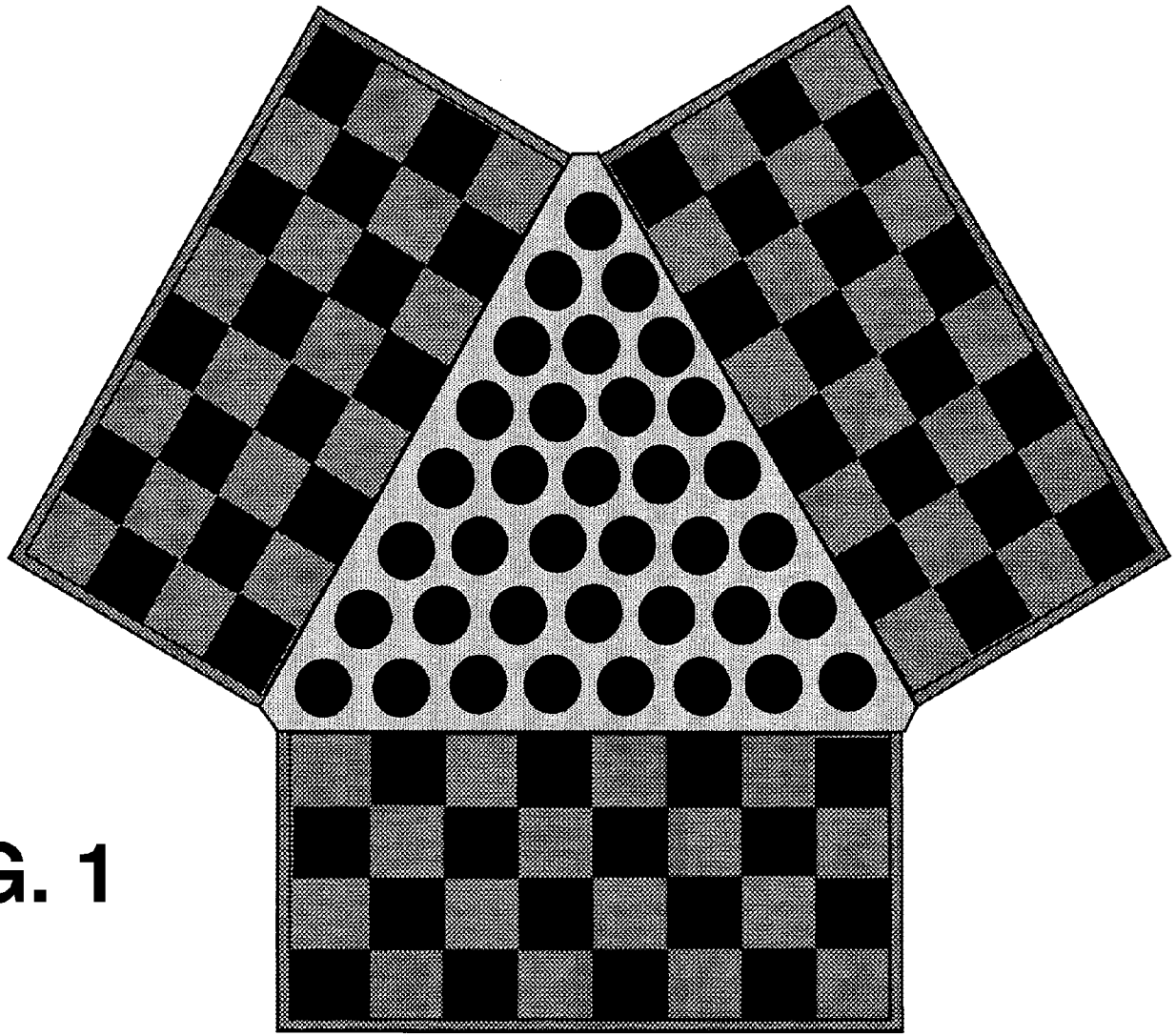
FIG. 1 is a topside view of the game board for three players according to a first embodiment of the present invention.
Figure 10:
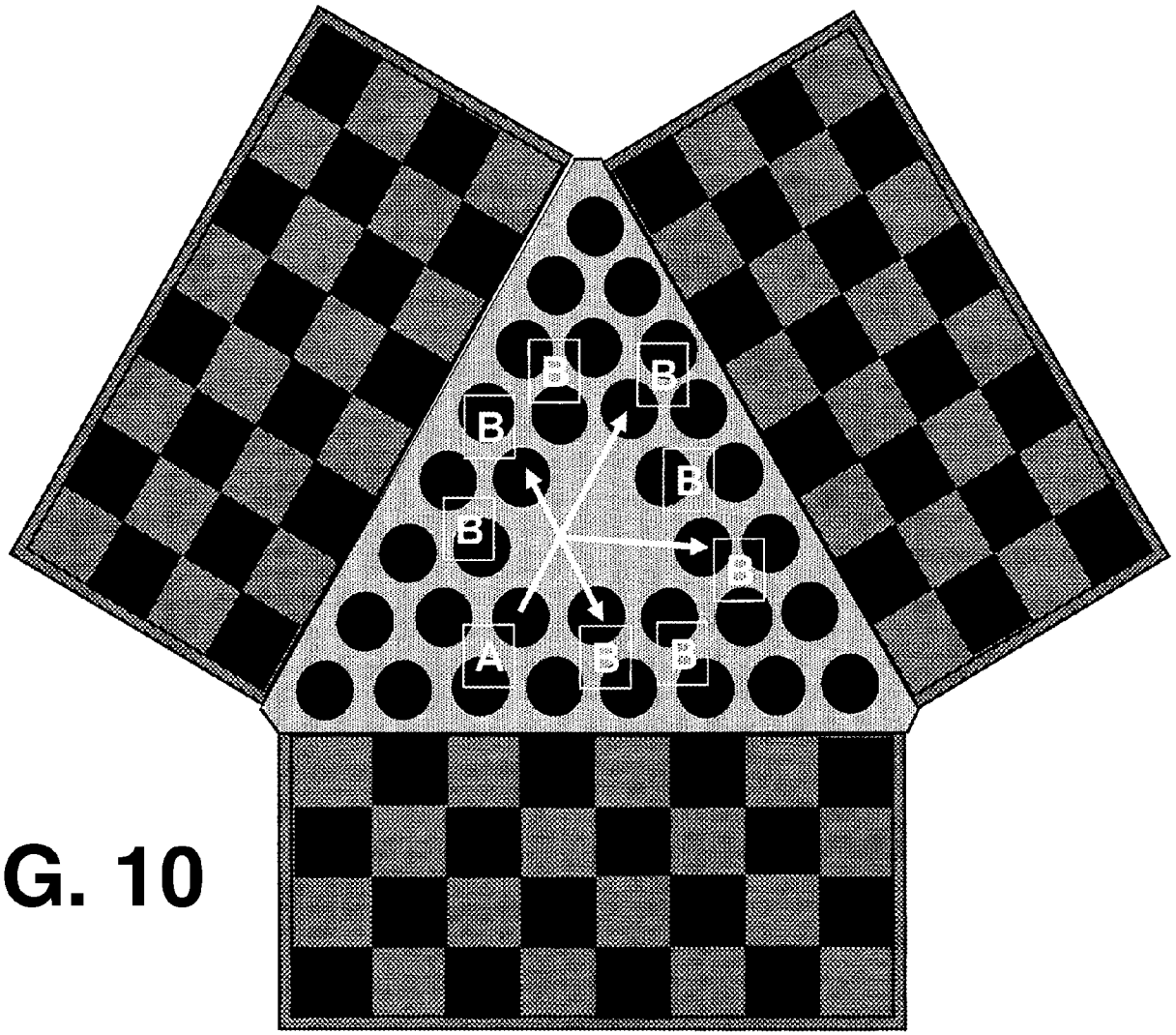
FIG. 10 is a schematic view of moves that may be made by an unimpeded game piece inside the Battle Zone according to the second embodiment of the present invention.

The present game features a gameboard made up of three equivalent rectangles, each attached along their longer axes to a side of an equilateral triangle that forms the center of the board. Each rectangle, called a "Base," is divided into four rows of eight squares, one-half of which are the same "dark" color and the other half of which are the same "light" color. The squares alternate by color so that no dark square is adjacent to another dark square. The squares of each Base are marked with a device in a color to identify that Base with the pieces for which that Base is "Home" and to differentiate that Base from the Home Base of the other players. The triangle at the center of the board, called the "Battle Zone," is composed of three concentric equilateral triangles made up of discs the color of the dark squares in the Bases. The background of the Battle Zone is the same color as the light squares in the Bases. Each of the discs is approximately the same diameter as the length of a side of the squares. There are 36 discs in the Battle Zone, with the outermost triangle having eight discs to a side, the central triangle being made up of only three discs, and the remaining triangle having five discs to the side, as shown in FIG. 1. In an alternate version of the game, described below, the three-disc central triangle is eliminated and there are only 33 discs in the Battle Zone, contained in an outer triangle with eight discs to the side and an inner triangle with five discs to the side, as shown in FIG. 10.

A set of twelve game pieces, or "checkers," is assigned to each player. The checkers are all the same color, but each set of twelve is marked with a device in the same color as the identifying color of one of the three Bases to identify that set of pieces as belonging to that Base. The pieces can resemble classical checkers—cylinders with a diameter approximately three times their height—or other objects, so long as the design and/or color device of each set of twelve pieces is sufficient to identify the members of that set of twelve pieces with each other, to differentiate them from the members of the other two sets, and to allow for signification that a piece has attained the status of a "King." The sets of pieces, or checkers, can be made of wood, plastic, metal or other materials.

In playing, each player sits directly behind the Base whose pieces he or she is to play. The player's pieces are aligned, one to a square, on the dark squares of the three rows of the Base closest to the player, leaving the row of each Base adjacent to the Battle Zone empty at the beginning of play. Inside the Bases, the game is played only on the dark squares, and no player's pieces can ever occupy the light squares.

The players select the method by which they will determine which of them plays first, with one method being the rolling of dice, with the player rolling the highest number beginning play. After the beginning player's turn, play passes to the next player in a counterclockwise direction. During a turn, a player may move only one of the player's pieces.

Unless the piece has been "crowned" or attained the status of a "King," as hereinafter described, a piece while inside a Base (either the player's Home Base or the Home Base of another player), may be moved only in a forward direction, that is, away from the player. While inside a Base, and except when executing a "jump" or series of "jumps," a piece may move only to an unoccupied dark square diagonally adjacent to and forward from the dark square occupied by that piece. If a dark square diagonally adjacent to and forward from the square occupied by the piece is occupied by a piece of an opponent, the player may capture the opponent's piece, if the dark square diagonally adjacent to and forward of the opponent's piece and on the same diagonal with the player's piece, is unoccupied. The player achieves this capture by moving the piece across the opponent's piece diagonally to the unoccupied dark square, a move called a "jump." The player then removes the captured opponent piece from the board. If immediately after an initial jump, the jumping piece occupies a square that is diagonally adjacent to a forward square occupied by an opponent's piece and the next forward square on the same diagonal is not occupied, the player may continue his move by jumping the second opponent piece, a move called a "double jump."

In addition to the fact that there can be three players, the primary difference between the present game and traditional checkers is the presence of the Battle Zone and the method of play therein.

Figure 2:
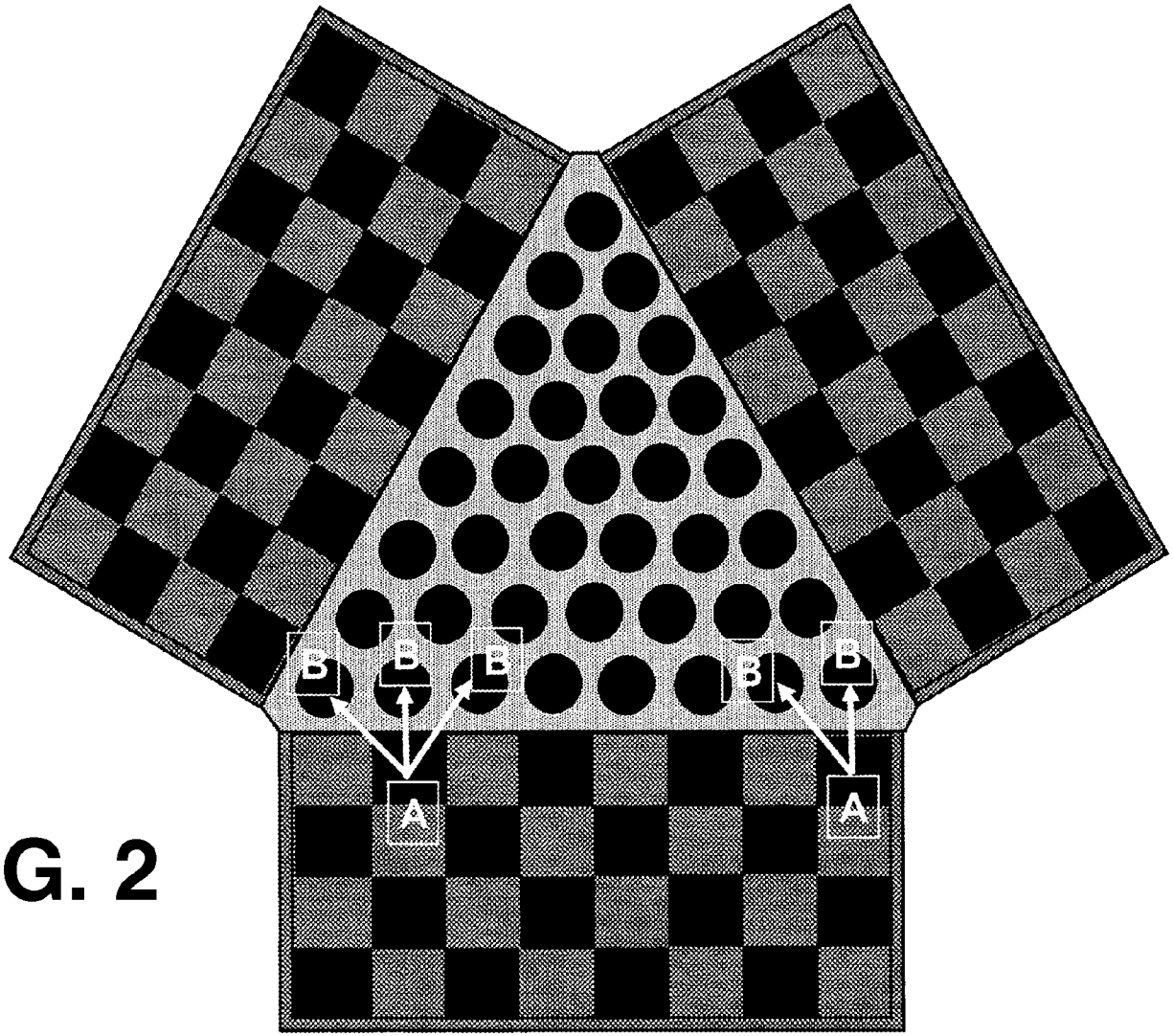
FIG. 2 is a schematic view of the moves that may be made by an unimpeded game piece to enter the Battle Zone according to the first embodiment or a second embodiment of the present invention.
Figure 3:
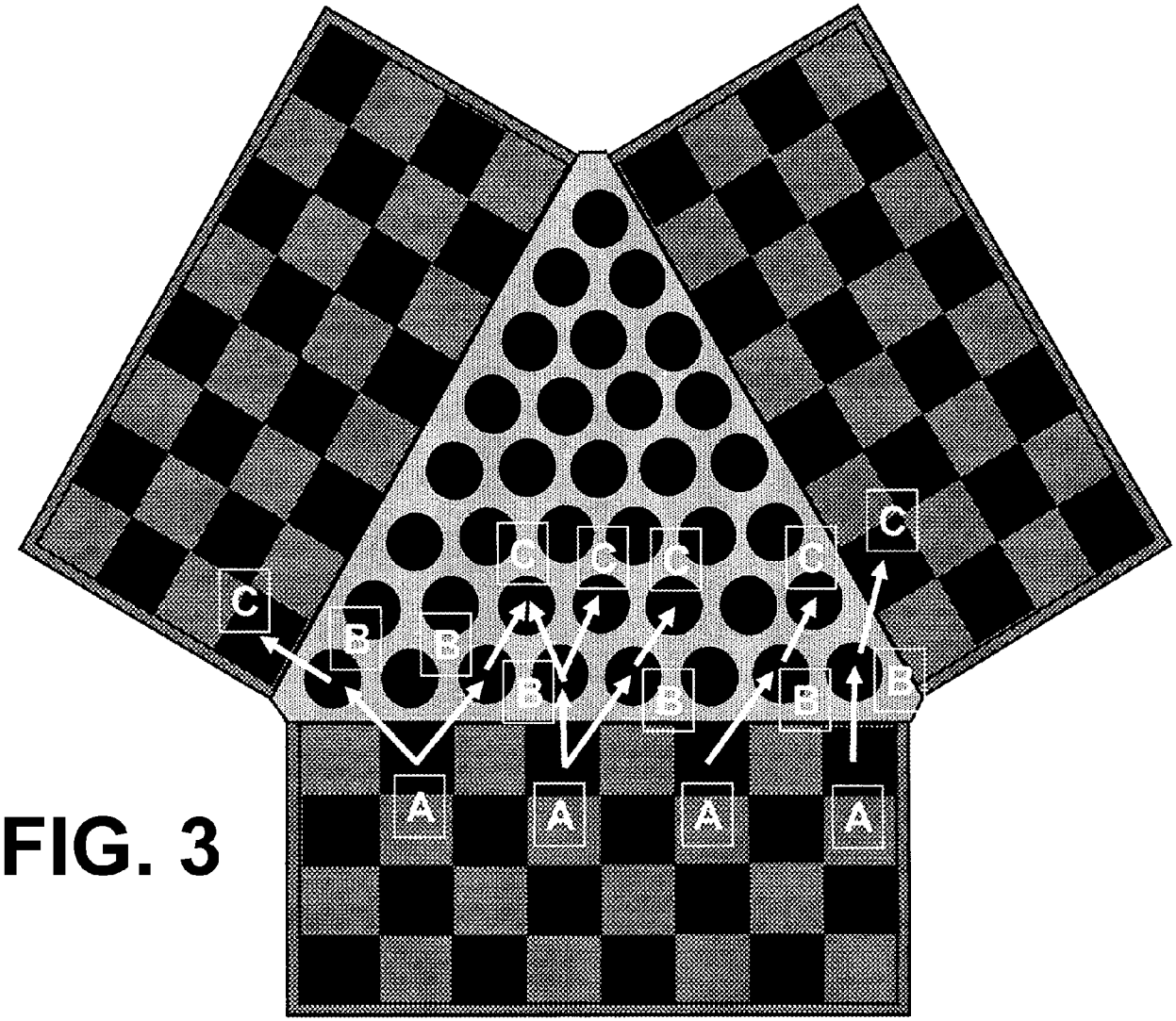
FIG. 3 is a schematic view of the moves that may be made by a game piece to enter the Battle Zone by jumping and capturing an opponent's game piece according to the first embodiment or the second embodiment of the present invention.
Figure 4:
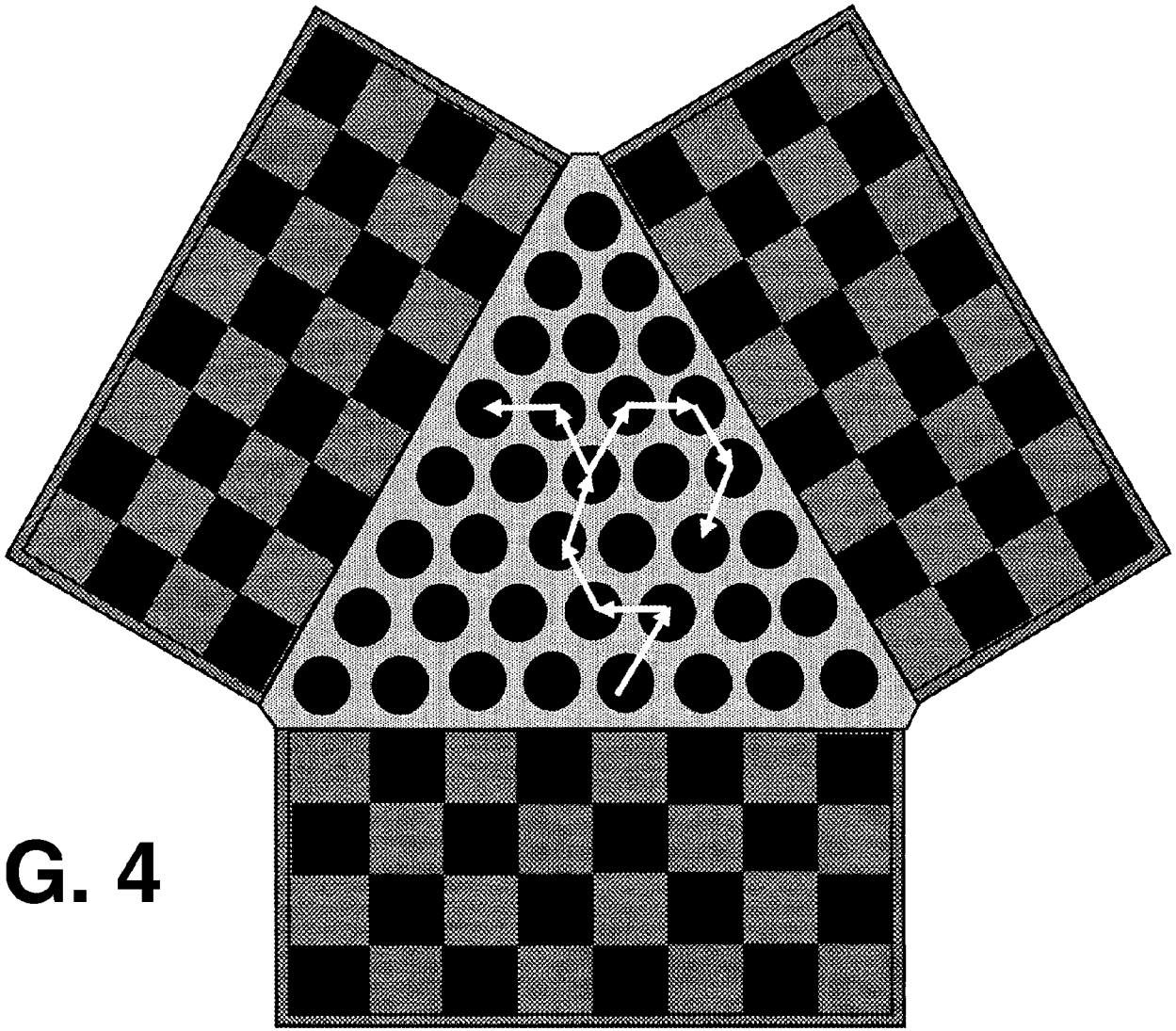
FIG. 4 is a schematic view of the moves that may be made by an unimpeded game piece inside the Battle Zone according to the first embodiment of the present invention.
Figure 5:
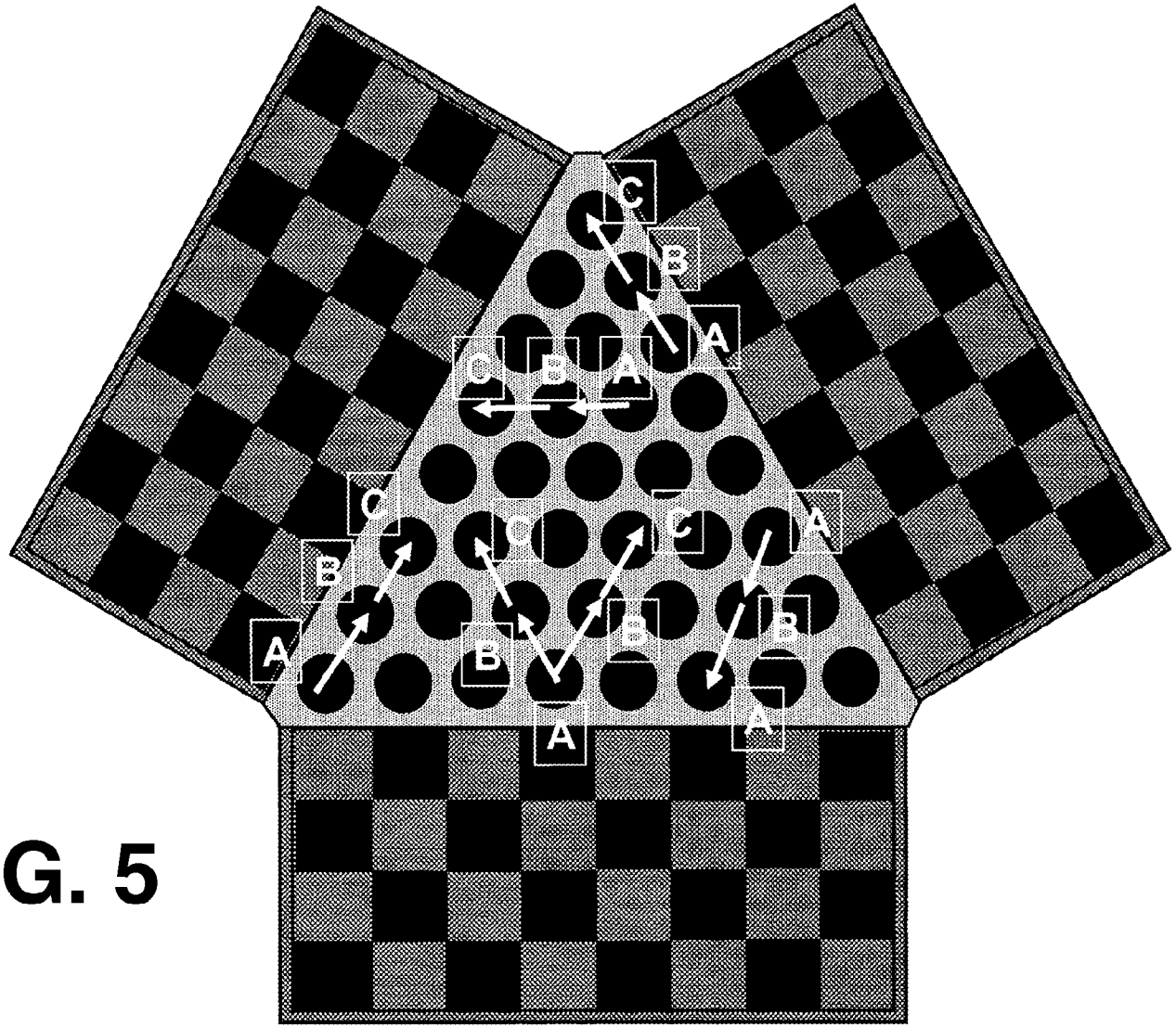
FIG. 5 is a schematic view of the moves that may be made by a game piece to jump and capture an opponent's game piece inside the Battle Zone according to the first embodiment of the present invention.
Figure 6:
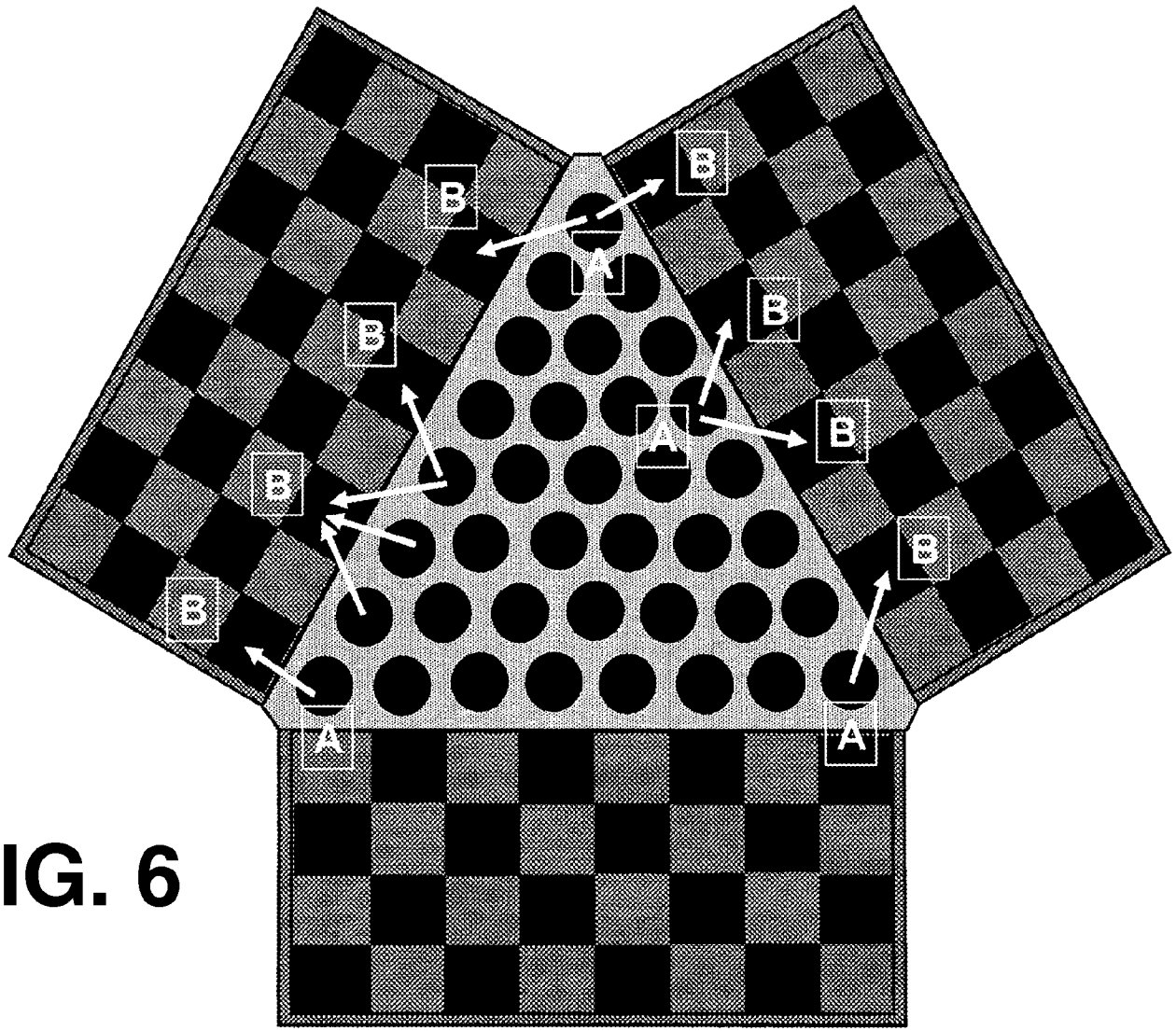
FIG. 6 is a schematic view of the moves that may be made by an unimpeded game piece to exit the Battle Zone and enter an opponent's Base according to the first embodiment or the second embodiment of the present invention.
Figure 7:
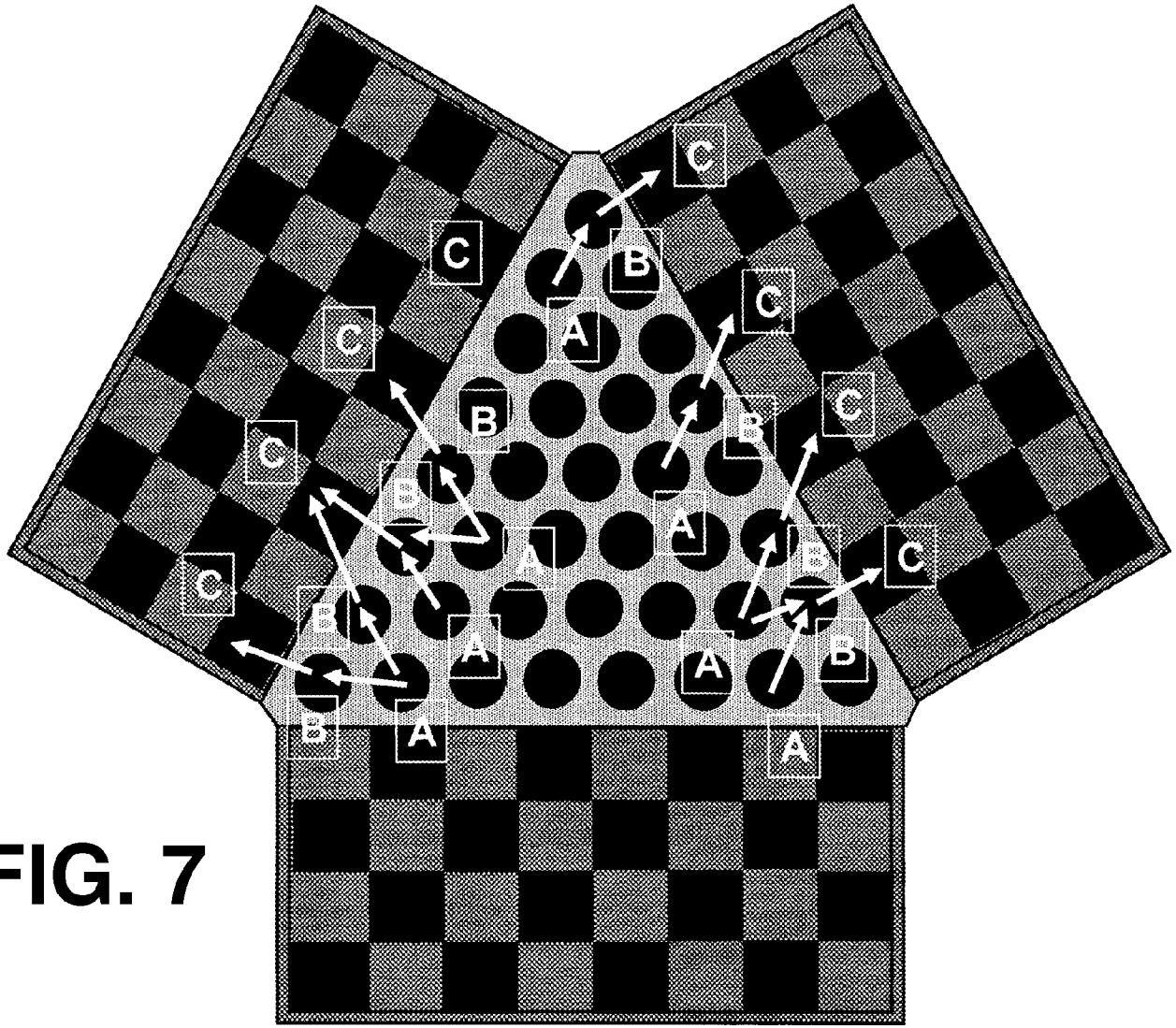
FIG. 7 is a schematic view of the moves that may be made by a game piece to jump and capture an opponent's game piece to exit the Battle Zone and enter an opponent's Base according to the first embodiment of the present invention.
Figure 8:
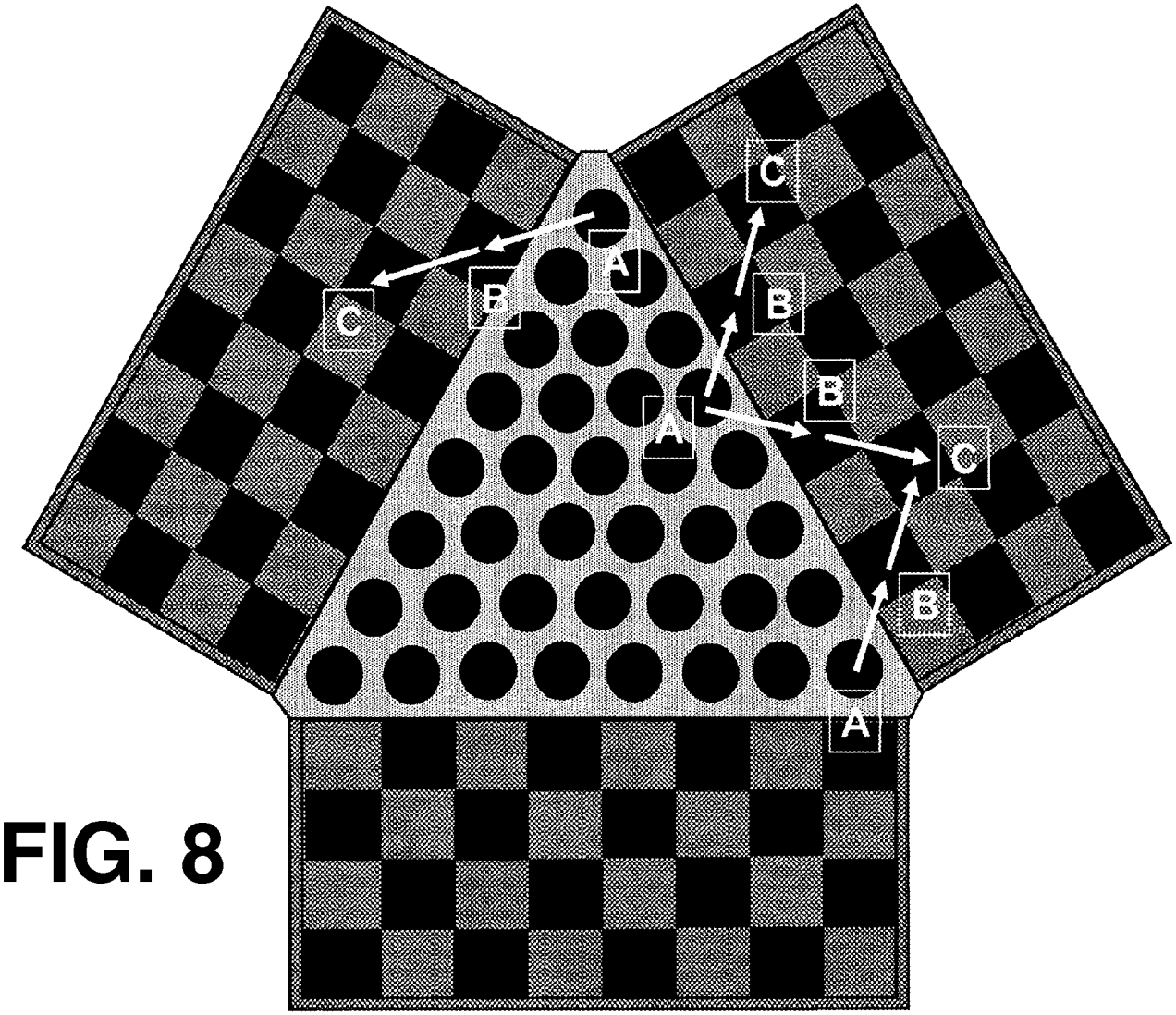
FIG. 8 is a schematic view of the moves that may be made by a game piece located on the outer row of Battle Zone discs to "jump" an opponent's piece and move into an opponent's Base according to the first embodiment of the present invention.

A player's piece enters the Battle Zone from the player's Home Base by moving forward to any unoccupied directly or diagonally adjacent dark disc (see FIG. 2) or by jumping and capturing an opponent's piece that occupies a diagonally adjacent dark disc or the adjacent disc directly forward of the square occupied by the jumping piece (see FIG. 3). Inside the Battle Zone, the player may move the player's piece in any direction, but may not return that piece to its Home Base unless the piece has been "crowned" (see FIG. 4). The piece proceeds though the Battle Zone by moving one disc per move or jumping an opposing player's piece that occupies an adjacent disc (see FIG. 5). A player's piece leaves the Battle Zone by entering an opponent's Base and occupying an adjacent dark square that is directly or diagonally forward of the Battle Zone disc occupied by the piece (see FIG. 6) or by jumping an opponent's piece that occupies a diagonally adjacent forward disc on the outer row of Battle Zone discs (see FIG. 7) or by jumping an opponent's piece that occupies a dark square diagonally adjacent to the disc on the outer row of Battle Zone discs that is occupied by the player's piece (see FIG. 8).

Inside an opponent's Base, the piece moves forward only, in the same manner as inside its Home Base, toward the last row of the opponent's Base. Upon reaching this last row, piece is "crowned" and becomes a "King." To signify that a piece has been crowned, one of that player's pieces that has been captured by an opponent and removed from play is stacked atop or otherwise attached to the piece being crowned and thereafter the attached or stacked pieces are moved together. The movements of a King differ from those of other pieces only in that a King may move diagonally forward or backward inside any Base that it occupies. This ability to move forward or backward on the diagonal makes it possible for a King to execute a Triple Jump or Quadruple Jump or even more complex moves so long as opponents' pieces are aligned to allow such moves. Inside the Battle Zone, the King moves in the same manner as any other piece. A King can only be jumped by an opposing King.

Play continues until only one player has pieces remaining on the board.

The first embodiment of the invention is thus seen to be a checker-type game for three players which includes a board, three sets of twelve checker pieces, and a set of rules.

The board is divided into four areas, with three of these areas being rectangles, the length of whose sides bear a 2:1 ratio, and the fourth area being an equilateral triangle whose sides are the length of the longest side of the rectangles. Each rectangle, called a "Base," is attached, at one of its long sides, to a different side of the triangular area, which is called the "Battle Zone." Each Base is divided into four rows of eight squares each, with the squares being in alternating colors of dark and light so that no two squares of the same color abut each other. The Battle Zone is composed of three concentric equilateral triangles made up of dark discs, each of which discs has a diameter equal to the width of the sides of the squares in each Base, with the discs being overlaid on a background in the light color of the squares in the Bases. There are 36 dark discs in the Battle Zone.

Regarding the three sets of twelve checker pieces, the pieces are in the shape of a cylinder whose height is one-third of the diameter of its base, which diameter is less than the length of the sides of the squares of each Base described in the paragraph immediately above, with each set being distinguished from the other by color.

The set of rules for the first embodiment, which are for playing a modified game of conventional checkers, are as follows:

The board is divided into four areas, three of which are rectangles, and each player adopts one rectangle as his Base.

Each player is provided with a set of twelve pieces.

Each player competes with both of the other players to remove all checker pieces other than that player's own checker pieces from the board.

Play begins with each player's pieces set up on the alternating dark squares of the three rows of that player's Base nearest to the long edge of the Base, with one piece placed on each square.

Each player is positioned facing the center of the board and behind the Player's Base.

The players roll dice, and the player rolling the highest number makes the first "move" of the game, with play proceeding in a counterclockwise direction and each Player limited to one move per turn.

In the Player's own Base, the Player may advance the Player's piece diagonally to any unoccupied adjacent dark square, and if a diagonally adjacent dark square is occupied by an opponent's piece, the Player may capture the opponent's piece and remove it from the board if the dark square next adjacent to the opponent's piece (and on the same diagonal as the Player's piece) is vacant and the Player advances the Player's piece to that vacant square, a move called "jumping."

A Player enters the Battle Zone from the Player's Base by moving to any unoccupied diagonally adjacent dark disc, or by "jumping" and capturing an opponent's piece located on the disc directly in front of the Player's piece or the disc to either side of that disc.

A Player proceeds through the Battle Zone by moving one disc at a time or by jumping an opponent's piece that occupies an adjacent disc, and the Player may move the Player's piece in any direction, but may not return a piece to the Player's Base unless that piece has been "crowned," as described in the two paragraphs immediately hereinbelow.

A Player's piece leaves the Battle Zone by entering an opponent's Base and then proceeds, as in traditional checkers, by moving forward and only in the manner allowed in the Player's own Base, toward the last row of the opponent's Base where it will be "crowned," after which that piece can be moved backwards and forwards in the Base areas as well as in the Battle Zone.

To signify that a piece has been "crowned" one of that Player's pieces that has been captured by any opponent and removed from play is stacked atop the piece being crowned and thereafter the stacked pieces are moved as a unit.

Players may execute "double jumps" or "triple jumps" as in classical checkers.

As noted above, play continues until only one player has pieces remaining on the board.

Figure 9:
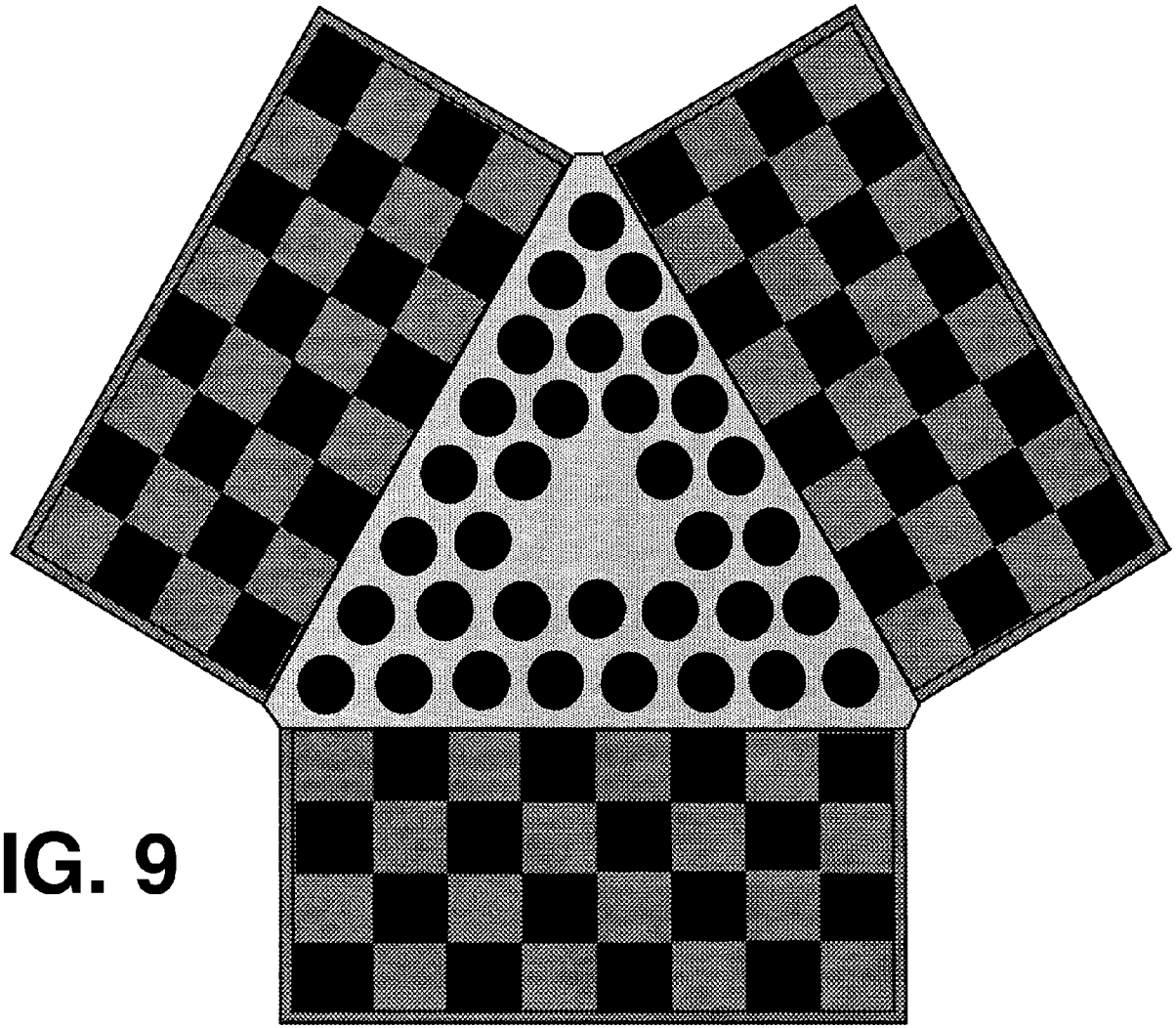
FIG. 9 is a schematic view of the configuration of the gameboard according to the second embodiment of the present invention.

In a second embodiment or version of this game, the Battle Zone is comprised of only two concentric equilateral triangles, one with eight dark discs to a side and the other with five dark discs to a side. The central area framed by these triangles is empty and is called the "Mine Field" (see FIG. 9). The gameboard is otherwise the same for this embodiment as for the first embodiment.

Play of the game differs for the second embodiment only with regard to movements related to the Mine Field. Because a player's piece in the Battle Zone cannot be moved parallel to the long side of the Player's Base, each piece must pass through the Mine Field on its way to an opponent's Base. A piece may not come to rest in the Mine Field, but must pass into and out of it in a single move (see FIG. 10). Thus, a piece located on the exterior triangle of the Battle Zone (the row next to the Player's Base) may jump an opponent's piece located directly or diagonally in front of it, touch down in the Mine Field and move immediately out of it, landing on an unoccupied disc on the interior triangle or again jumping an opponent's piece located on the interior triangle and ending the move by landing on a disc on the exterior triangle (see FIG. 11). Play of the game in this second embodiment is otherwise identical to that in the first embodiment.

Play of the second embodiment is more difficult than the first embodiment because the Battle Zone is more constricted.

The second embodiment of the invention is thus seen to be a variation of the first embodiment, wherein the Battle Zone consists of only two concentric equilateral triangles made of dark discs, with one having eight discs to a side and the other having five discs to a side, the center of which concentric triangles consists of a triangular void called the "Mine Field."

The game board is identical to that of the first embodiment, except for the differences in the arrangement of the Battle Zone described in the paragraph immediately hereinabove.

The rules of play for the second embodiment of the game are identical to that of the first embodiment, except for the following differences related to play in the Battle Zone and Mine Field:

Because a piece in the Battle Zone may not be moved parallel to the longest side of its Player's Base, the piece must pass through the Mine Field on its way to an opponent's Base, but may not come to rest in the Mine Field. A piece must move into and out of the Mine Field in the same turn of play.

A piece may "jump" and capture an opponent's piece on its way into or out of the Mine Field.

As with the first embodiment, play continues until only one player has pieces remaining on the board.

I claim:

1. A method of playing a game of checkers for three players, said method comprising:

(a) providing a game board, said game board comprising a battle zone and a first base, a second base, and a third base, each said base being for a respective one of said players; said battle zone being a closed polygon having a first battle zone side, a second battle zone side, and a third battle zone side, said first battle zone side being angled at sixty degrees with respect to said second battle zone side, said second battle zone side being angled at sixty degrees with respect to said third battle zone side, and said third battle zone side being angled at sixty degrees with respect to said first battle zone side; each said base being substantially rectangular and being divided into first, second, third, and fourth sequential rows and into eight columns of alternating light and dark colored playing squares with said first row of said first base abutting said first battle zone side, with said first row of said second base abutting said second battle zone side, and with said first row of said third base abutting said third battle zone side; said battle zone consisting of thirty-six discs arranged in a triangular pattern, said triangular pattern having a first equilateral triangle having a first perimeter formed by twenty-one of said thirty-six discs, a second equilateral triangle having a second perimeter interior of said first perimeter and formed by twelve of said thirty-six discs, and a third equilateral triangle having a third perimeter interior of said second perimeter and formed by three of said thirty-six discs; said first, said second, and said third equilateral triangles having like orientation with said first, said second, and said third battle zone sides;

(b) providing a first, a second, and a third set consisting of twelve checker pieces each, one said set respectively being for each said player, each said set being of like color and each said set being distinguished from each other said set by color;

(c) initially placing each player's set of checker pieces onto said game board so that one of said checker pieces of each respective said set initially occupy each said dark colored playing square of said second, third, and fourth rows of said player's base;

(d) selecting one of said players to start said game, then each said player, in turn, making a move of one of said player's checker pieces during each said turn, each said move being according to game rules of:

i. when said one moved checker piece is within said player's base, if a diagonally-adjacent said dark colored playing square is unoccupied, said one moved checker piece may be moved to said unoccupied diagonally-adjacent dark colored playing square; else if said diagonally-adjacent dark colored playing square is occupied by another player's checker piece and further if, along a same diagonal as said occupied diagonally-adjacent dark colored playing square, a next dark colored playing square is unoccupied, said one moved checker piece may be moved to said unoccupied next dark colored playing square along said diagonal and said another player's checker piece shall be removed from said game board;

ii. when said one moved checker piece is within said player's base, if an adjacent or immediately forward first disc of said battle zone is unoccupied, said one moved checker piece may be moved only to said unoccupied first disc of said battle zone; else if said adjacent or said immediately forward first disc is occupied by another player's checker piece and also if a second disc further diagonally forward adjacent to said first disc is unoccupied, said one moved checker piece may be moved to said unoccupied second disc and said another player's checker piece occupying said first disc shall be removed from said game board, and if also a third disc diagonally forward adjacent said second disc in a first jumping direction is then occupied by another player's checker piece and a fourth disc along said first jumping direction is unoccupied, then said one moved checker piece may continue to be moved to said fourth disc and said another player's checker piece occupying said third disc shall be removed from said game board;

iii. when said one moved checker piece is within said battle zone, if a diagonally-adjacent thereto said disc is unoccupied, said one moved checker piece may be moved to said unoccupied diagonally-adjacent disc;

else if said diagonally-adjacent disc is occupied by another player's checker piece and further if, along a same diagonal as said occupied diagonally-adjacent disc, a next disc is unoccupied, said one moved checker piece may be moved to said unoccupied next disc along said diagonal and said another player's checker piece shall be removed from said game board;

iv. said one moved checker piece may exit said battle zone and enter another player's said base by:

A. if an adjacent or immediately forward first dark colored playing square in said another player's said base is unoccupied, moving from said battle zone to said unoccupied adjacent or immediately forward first dark colored playing square in said another player's said base;

B. if said adjacent or immediately forward first dark colored playing square is occupied by another player's checker piece and a second dark colored playing square diagonally adjacent thereto is unoccupied, moving from said battle zone to said unoccupied second dark colored playing square and removing said another player's checker piece occupying said first dark colored playing square shall be removed from said game board;

C. if an adjacent or immediately forward first disc on said first equilateral triangle is occupied by another player's checker piece and a third dark colored playing square diagonally adjacent thereto is unoccupied, moving from said battle zone to said unoccupied third dark colored playing square and removing said another player's checker piece occupying said first disc on said first equilateral triangle shall be removed from said game board, and if also a fourth dark colored playing square adjacent said third dark colored playing square diagonally forward in a second jumping direction is then occupied by another player's checker piece and a fifth dark colored playing square adjacent thereto diagonally forward along said second jumping direction is unoccupied, then said one moved checker piece may continue to be moved to said fifth dark colored playing square and said another player's checker piece occupying said fourth dark colored playing square shall be removed from said game board;

D. upon reaching said fourth row of another player's said base, said one moved checker piece becomes crowned by stacking a checker piece of like color thereatop, after which said crowned checker piece may thereafter move forward and backward within said bases and within said battle zone;

(e) each said player moving, in turn, until only checker pieces of one winning player remain unremoved from said game board.

2. A method of playing a game of checkers for three players, said method comprising:

(a) providing a game board, said game board comprising a battle zone and a first base, a second base, and a third base, each said base being for a respective one of said players; said battle zone being a closed polygon having a first battle zone side, a second battle zone side, and a third battle zone side, said first battle zone side being angled at sixty degrees with respect to said second battle zone side, said second battle zone side being angled at sixty degrees with respect to said third battle zone side, and said third battle zone side being angled at sixty degrees with respect to said first battle zone side; each said base being substantially rectangular and being divided into first, second, third, and fourth rows and into eight columns of alternating light and dark colored playing squares with said first row of said first base abutting said first battle zone side, with said first row of said second base abutting said second battle zone side, and with said first row of said third base abutting said third battle zone side; said battle zone consisting of thirty-three discs arranged in a triangular pattern, said triangular pattern having a first equilateral triangle having a first perimeter formed by twenty-one of said thirty-three discs, and a second equilateral triangle having a second perimeter interior of said first perimeter and formed by twelve of said thirty-three discs; said first and said second equilateral triangles having like orientation with said first, said second, and said third battle zone sides; said second perimeter of said second equilateral triangle defining a mine field interior of said twelve of said thirty-three discs;

(b) providing a first, a second, and a third set consisting of twelve checker pieces each, one said set respectively being for each said player, each said set being of like color and each said set being differently-colored from each other said set;

(c) initially placing each player's set of checker pieces onto said game board so that one of said checker pieces of each respective said set initially occupy each said dark colored playing square of said second, third, and fourth rows of said player's base;

(d) selecting one of said players to start said game, then each said player, in turn, making a single move of one of said player's checker pieces during each said turn, each said move being according to game rules of:

i. when said one moved checker piece is within said player's base, if a diagonally-adjacent said dark colored playing square is unoccupied, said one moved checker piece may be moved to said unoccupied diagonally-adjacent dark colored playing square; else if said diagonally-adjacent dark colored playing square is occupied by another player's checker piece and further if, along a same diagonal as said occupied diagonally-adjacent dark colored playing square, a next dark colored playing square is unoccupied, said one moved checker piece may be moved to said unoccupied next dark colored playing square along said diagonal and said another player's checker piece shall be removed from said game board;

ii. when said one moved checker piece is within said player's base, if an adjacent or immediately forward first disc of said battle zone is unoccupied, said one moved checker piece may be moved only to said unoccupied first disc of said battle zone; else if said adjacent or said immediately forward first disc is occupied by another player's checker piece and also if a second disc further diagonally forward adjacent to said first disc is unoccupied, said one moved checker piece may be moved to said unoccupied second disc and said another player's checker piece occupying said first disc shall be removed from said game board, and if also a third disc diagonally forward adjacent said second disc in a first jumping direction is then occupied by another player's checker piece and a fourth disc along said first jumping direction is unoccupied, then said one moved checker piece may continue to be moved to said fourth disc and said another player's checker piece occupying said third disc shall be removed from said game board;

iii. when said one moved checker piece is within said battle zone:

A. if a diagonally-adjacent thereto said disc is unoccupied, said one moved checker piece may be moved to said unoccupied diagonally-adjacent disc;

B. else if said diagonally-adjacent disc is occupied by another player's checker piece and further if, along a same diagonal as said occupied diagonally-adjacent disc, a next disc is unoccupied, said one moved checker piece may be moved to said unoccupied next disc along said diagonal and said another player's checker piece shall be removed from said game board;

C. else if said one moved checker piece is on one of said twelve of said thirty-three discs of said second perimeter of said second equilateral triangle, said one moved checker piece may either be moved to an unoccupied disc of said twelve of said thirty-three discs of said second perimeter of said second equilateral triangle or, if another player's checker piece occupies another one of said twelve of said thirty-three discs of said second perimeter of said second equilateral triangle then said one moved checker piece may be moved to an unoccupied disc of said twenty-one of said thirty-three discs of said first perimeter of said first equilateral triangle adjacent to said another player's said checker piece occupying said another one of said twelve of said thirty-three discs of said second perimeter of said second equilateral triangle and said another player's checker piece occupying said one of said twelve of said thirty-three discs of said second perimeter of said second equilateral triangle shall be removed from said game board;

D. else if said one moved checker piece is on a first one of said twenty-one of said thirty-three discs of said first perimeter of said first equilateral triangle and if another player's checker piece occupies a second one of said twelve of said thirty-three discs of said second perimeter of said second equilateral triangle adjacent said first one of said twenty-one of said thirty-three discs of said first equilateral triangle, then said one moved checker piece may be moved to an unoccupied disc of said twelve of said thirty-three discs of said second perimeter of said second equilateral triangle and said another player's checker piece occupying said second one of said twelve of said thirty-three discs of said second perimeter of said second equilateral triangle shall be removed from said game board;

iv. said one moved checker piece may exit said battle zone and enter another player's said base by:

A. if an adjacent or immediately forward first dark colored playing square in said another player's said base is unoccupied, moving from said battle zone to said unoccupied adjacent or immediately forward first dark colored playing square in said another player's said base;

B. if said adjacent or immediately forward first dark colored playing square is occupied by another player's checker piece and a second dark colored playing square diagonally adjacent thereto is unoccupied, moving from said battle zone to said unoccupied second dark colored playing square and removing said another player's checker piece occupying said first dark colored playing square shall be removed from said game board;

C. if an adjacent or immediately forward first disc on said first equilateral triangle is occupied by another player's checker piece and a third dark colored playing square diagonally adjacent thereto is unoccupied, moving from said battle zone to said unoccupied third dark colored playing square and removing said another player's checker piece occupying said first disc on said first equilateral triangle shall be removed from said game board, and if also a fourth dark colored playing square adjacent said third dark colored playing square diagonally forward in a second jumping direction is then occupied by another player's checker piece and a fifth dark colored playing square adjacent thereto diagonally forward along said second jumping direction is unoccupied, then said one moved checker piece may continue to be moved to said fifth dark colored playing square and said another player's checker piece occupying said fourth dark colored playing square shall be removed from said game board;

D. upon reaching said fourth row of another player's said base, said one moved checker piece becomes crowned by stacking a checker piece of like color thereatop, after which said crowned checker piece may thereafter move forward and backward within said bases and within said battle zone;

(e) each said player moving, in turn, until only checker pieces of one winning player remain unremoved from said game board.

* * * * *